United States Patent [19]

Brown et al.

[11] Patent Number: 4,817,520

[45] Date of Patent: Apr. 4, 1989

[54] COMPACTOR WITH CONTROL APPARATUS FOR OFFSETTING OPERATION BETWEEN A GATE AND A RAM

[75] Inventors: Ronald L. Brown, Vernon; James K. Robbins, Fayette, both of Ala.; Kent Spiers, Caledonia, Miss.

[73] Assignee: Marathon Corporation, Birmingham, Ala.

[21] Appl. No.: 74,213

[22] Filed: Jul. 16, 1987

[51] Int. Cl.[4] ..... B30B 1/08; B30B 15/16

[52] U.S. Cl. ..... 100/41; 100/50; 100/191

[58] Field of Search ..... 100/218, 245, 191, 50, 100/188, 192, 41, 190, 179, 250, 269 R

[56] References Cited

U.S. PATENT DOCUMENTS

| | | | |
|---|---|---|---|
| 2,780,987 | 2/1957 | Wall | 100/218 |
| 2,902,922 | 9/1959 | Williams | 100/192 X |
| 3,350,999 | 11/1967 | Morse | 100/191 X |
| 3,657,999 | 4/1972 | White | 100/192 |
| 3,747,519 | 7/1973 | Capps, Sr. et al. | 100/218 |
| 3,789,752 | 2/1974 | Wirz | 100/192 X |
| 3,893,385 | 7/1975 | White | 100/53 |
| 3,962,968 | 6/1976 | Tribbett et al. | 100/190 X |
| 4,166,414 | 9/1979 | Fleming et al. | 100/192 X |
| 4,624,180 | 11/1986 | Strosser | 100/191 |

*Primary Examiner*—Andrew M. Falik

*Attorney, Agent, or Firm*—Shlesinger, Arkwright & Garvey

[57] ABSTRACT

An offset compactor assembly includes an elongated chamber having a waste receiving end portion and a waste discharge end. A ram is displaceable therein for causing compaction of waste during transfer therebetween. A first cylinder and piston assembly is operably connected to the ram for causing displacement thereof. A gate is positioned proximate said end and is movable into and out of said chamber for selectively restricting said chamber and thereby controlling the passage of waste therethrough. A second cylinder and piston assembly is operably connected to the gate for causing displacement thereof. An hydraulic control operably interconnects the first and second cylinder and piston assemblies for causing offsetting operation thereof so that the waste compacted in the chamber has a substantially uniform density.

27 Claims, 3 Drawing Sheets

COMPACTOR WITH CONTROL APPARATUS FOR OFFSETTING OPERATION BETWEEN A GATE AND A RAM

BACKGROUND OF THE INVENTION

Many localities now initially compact collected waste prior to transporting the waste to a landfill in which permanent storage is effected. Initial compaction reduces the volume of waste which must be stored, and thereby maximizes the life of the landfill. Furthermore, compaction also reduces the number of trips required to transport a given mass of waste, and thereby permits greater efficiencies to be realized. Many jurisdictions have more than one waste collector and it is not cost effective for each collector to have a commercial compactor. Consequently, a waste transfer station is normally used to permit all waste collectors to share in the benefits of a commercial compactor.

Waste collected at the waste transfer station is usually injected into a rigid reenforced trailer, or other similar container, by the stationary compactor. The trailer then transports the waste from the transfer station to the landfill, wherein the waste is dumped for burial. The practice of injecting the waste into the trailer typically results in relatively short service life of the trailer, due to the services involved. The ever increasing cost of transportation has lead to an attempt to obtain greater densities of the compacted waste, thereby increasing the internal pressure applied to the trailer. The increased pressure and density require further structural reinforcement of the trailer, thereby increasing the tare weight and reducing the legal payload capacity.

An S-tube compactor is one which utilizes the curvature of the compactor to assist, compaction of the waste. An exemplary disclosure thereof is found in U.S. Pat. No. 3,893,385, issued July 8, 1975, to Lewis White for Horizontal Trash Compactor, the owner of which is also the owner of the present application, and the disclosure of which is herein incorporated by reference. That patent discloses a compactor having a horizontal and a vertical section and a gate for increasing the compaction therein. Experience has now disclosed, however, that the location of the gate of White does not permit accurate uniform compaction to be achieved, particularly when the compactor is subject to waste inputs of varying feed rate and varying density.

In view of the above, it can be seen that there is a need for a device which achieves relatively high and uniform compaction density of waste in order to reduce transportation costs, while also permitting more waste to be carried per unit trailer. The disclosed invention provides just such a compactor and method, and one which not only achieves substantially uniform compaction density, but which also adequately regulates the volume of the waste injected into the trailer.

OBJECTS AND SUMMARY OF THE INVENTION

The primary object of the disclosed invention is a compactor and method of operation which achieves relatively high and uniform compaction density prior to injection of the compacted waste into the trailer.

A compactor according to the invention has an elongated chamber with a waste receiving end portion and a waste discharge end. A ram is displaceable therebetween and causes compaction of the waste during transfer. A first cylinder and piston assembly is operably connected to the ram for causing displacement thereof. A gate is positioned within the chamber for selectively restricting the chamber and thereby regulating the passage of waste therethrough. A second cylinder and piston assembly is connected to the gate for causing selective displacement thereof. An hydraulic system having an offset operating means interconnects the two cylinder and piston assemblies so that increased operating pressure of one causes reduced operating pressure of the other, thereby achieving uniform compaction density by adjusting the position of the gate as a function of compaction.

The method of achieving uniform compaction density includes the provision of a compactor assembly having an elongated compactor chamber with a waste receiving opening at one end, a waste discharge opening at another end, a pivotal gate means intermediate the openings for selectively blocking the chamber and ram means for compacting the waste during transit between the openings. A quantity of waste is positioned in the chamber. The chamber is blocked by pivoting of the gate means so that waste is prevented from exiting the discharge opening. The waste is then compacted by advancement of the ram means towards the gate means. The gate means is selectively pivoted in response to the force required to displace the ram means so that the chamber is progressively unblocked as the force required to displace the ram means increases, and the chamber is progressively blocked as the force required to displace the ram means decreases.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
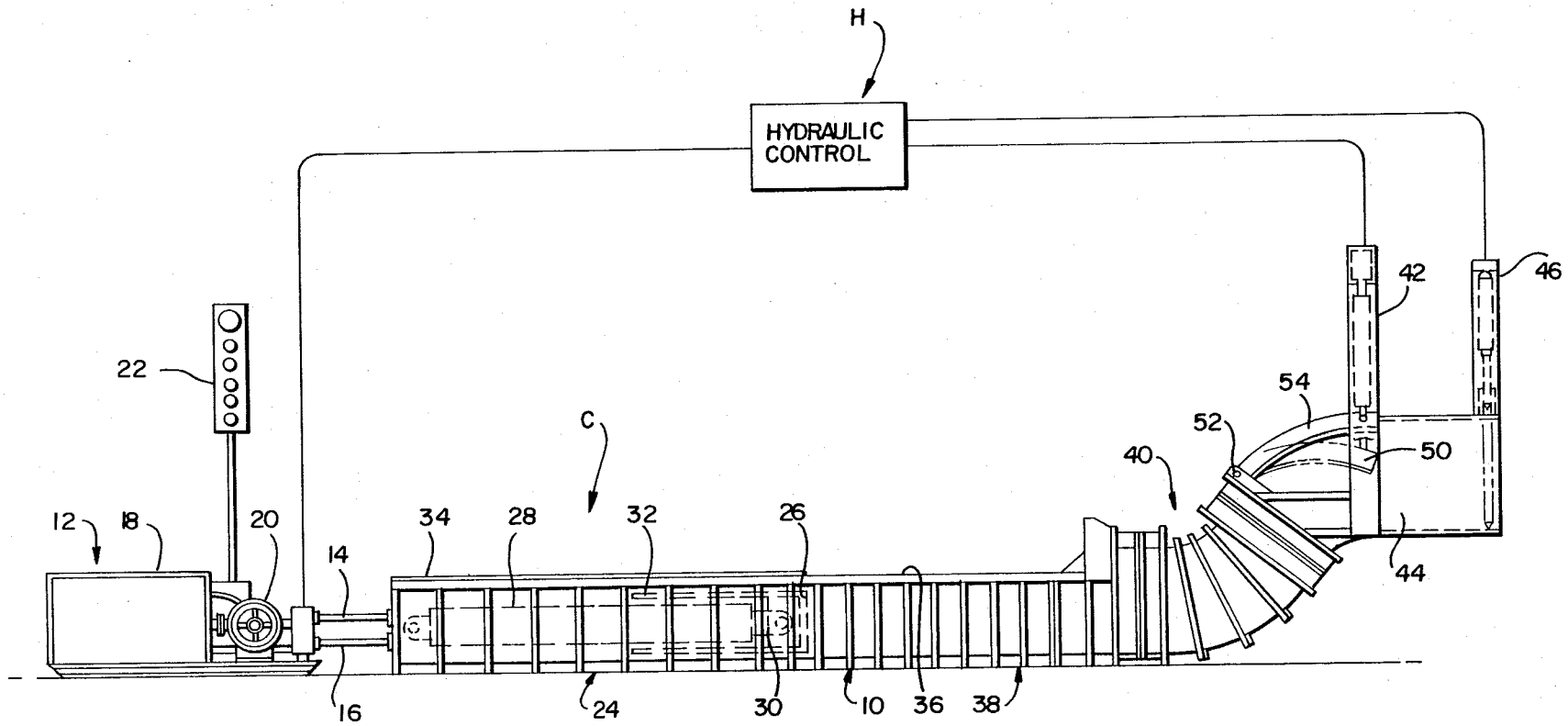
FIG. 1 is an elevational view, partially in schematic, and with dotted lines illustrating certain parts, disclosing the compactor of the invention.

Compactor assembly C, as best shown in FIG. 1, includes an elongated generally S-shaped chamber 10 to which hydraulic power supply 12 is operably connected through lines 14 and 16, as well as through other similar lines. The compactor assembly C is a commercial compactor, such as is used in a waste transfer station for compacting collected waste for injection into a trailer which hauls the compacted waste to a landfill or the like.

The hydraulic supply 12 includes a reservoir 18 and a positive, fixed displacement pump 20, which preferably has multiple pumping elements in order to maximize the motor horsepower used to generate a given displacement force. A remote control station 22 is operably connected with hydraulic supply 12 in order to cause operation of same.

Elongated chamber 10 has a first horizontal portion 24 in which ram 26 is positioned. A first cylinder 28 is connected to lines 14 and 16 and has a displaceable piston 30 operably connected with ram 26 for causing displacement of the ram 26 within the chamber 10. While one cylinder 28 and piston 30 are illustrated in FIG. 1, those skilled in the art will understand that a number of such assemblies can be provided, and FIG. 4 discloses a system utilizing two cylinder and piston assemblies for displacing the ram. Similarly, while the ram 26 is shown as having U-shaped design, those skilled in the art will understand that it is merely necessary for the ram 26 to provide a vertical face which contacts the waste for causing transport of same. The upper horizontal leg 32 serves as a gate valve when the piston 30 is in the extended position.

A cover 34 overlies first portion 24 and protects the cylinder 28 and piston 30 from contamination by waste, and from the elements. The cover 34 is disposed adjacent waste opening 36 of second horizontal portion 38. The second portion 38 is a tubular section which merges with forward generally S-shaped third portion 40. Those skilled in the art will understand that waste deposited through opening 36 into the interior of second portion 38 will be transported through S-shaped portion 40 by displacement of ram 26. The combined portions 24, 38 and 40 therefore define an elongated chamber, which chamber may be made of any desired cross-section and size.

Figure 3:
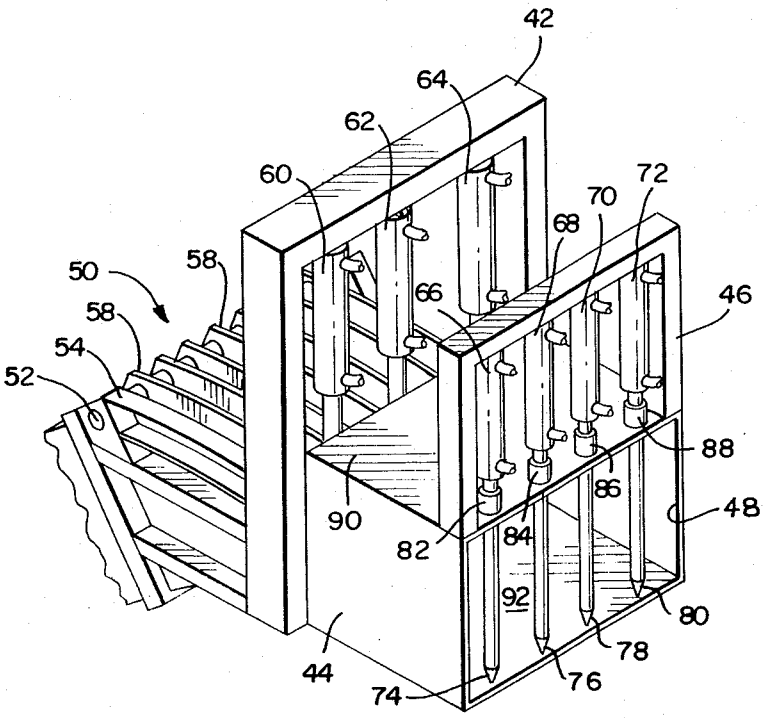
FIG. 3 is a fragmentary perspective view of the waste discharge end of the compactor of the invention; and, FIG. 4 is an hydraulic schematic illustrating the offsetting hydraulic system of the invention.

Frame 42 is mounted to the terminal end of S-shaped portion 40. Extension 44 continues horizontally from frame 42 and is of tubular form, as best shown in FIG. 3. A second frame 46 is secured to extension 42 above waste outlet 48, for reasons to be explained hereinafter, and is disposed parallel to frame 42. It can be seen, therefore, that waste deposited into opening 36 will, eventually, be discharged through outlet 48 by the displacement of ram 26.

Figure 2:
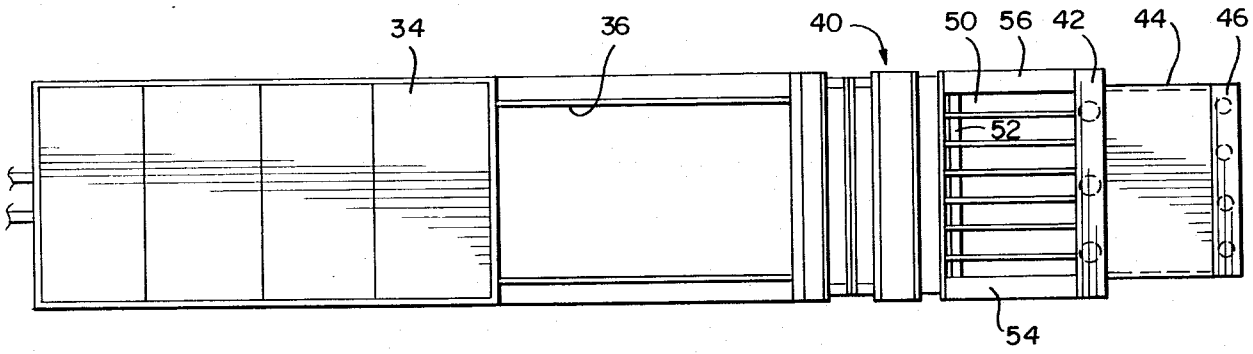
FIG. 2 is a top plan view thereof.

Gate 50, as best shown in FIGS. 2 and 3, is mounted to S-shaped portion 40 for rotation about horizontal shaft 52. The shaft 52 extends between side frames 54 and 56 which define therebetween a gate opening within S-shaped portion 40. Preferably, gate 50 is reenforced by a plurality of stiffners 58 which extend longitudinally along the gate 50 to provide support when the gate 50 is used as an arch breaker to crush or break articles which become lodged within the interior thereof. The gate 50 thereby defines a top wall for portion 40.

Cylinder and piston assemblies 60, 62 and 64 are pivotally secured to frame 42 and to gate 50 in order to cause pivoting of the gate 50 about the shaft 52 and into the interior of portion 40. FIG. 1 discloses the gate 50, in dotted form, as it has been moved into the interior of the elongated chamber of the S-shaped portion 40. Naturally, those skilled in the art will understand that the gate 50 may be pivoted into a position totally blocking the S-shaped portion 40, and thereby preventing waste from exiting therefrom through to extension 44. In this way, operation of the cylinder and piston assembly 60, 62 and 64 causes the gate opening of S-shaped portion 40 to become progressively blocked or unblocked, as will be further explained, in order to regulate the flow of waste through the chamber.

Cylinder and piston assemblies 66, 68, 70 and 72 are secured to frame 46 and are operably connected to pins 74, 76, 78 and 80 extending from the respective pistons. Guides 82, 84, 86 and 88 are mounted atop upper surface 90 of extension 44. The guides direct the pins 74, 76, 78 and 80 during their displacement through opening 48 to bottom surface 92.

Hydraulic control H monitors the circuit pressures and is operably connected to the cylinder assemblies 60, 62, and 64 controlling movement of the gate 50. The hydraulic control H assures that the pressures applied for displacing the ram 26 and for controlling pivoting of gate 50 are offsetting. In other words, hydraulic control H assures that the pressure applied to gate 50 decreases as the pressure applied to ram 26 increases, and vice versa. In this way, the gate 50 pivots between the open and the closed position in order to selectively block the chamber of S-shaped portion 40 so that the transfer of waste through the S-shaped portion 40 is regulated, and thereby uniform compaction density achieved. Those skilled in the art will understand that is is easier to transfer waste through the discharge opening 48 when the gate 50 is in the uppermost or open position than it is when the gate 50 is in the blocking position, and pivoting of the gate 50 thereby assures regulation in the compaction density of the waste. It should be pointed out that upward pivoting of gate 50 is, to a large extent, caused by the force applied by the compacting waste, rather then by retraction of the pistons.

Figure 4:
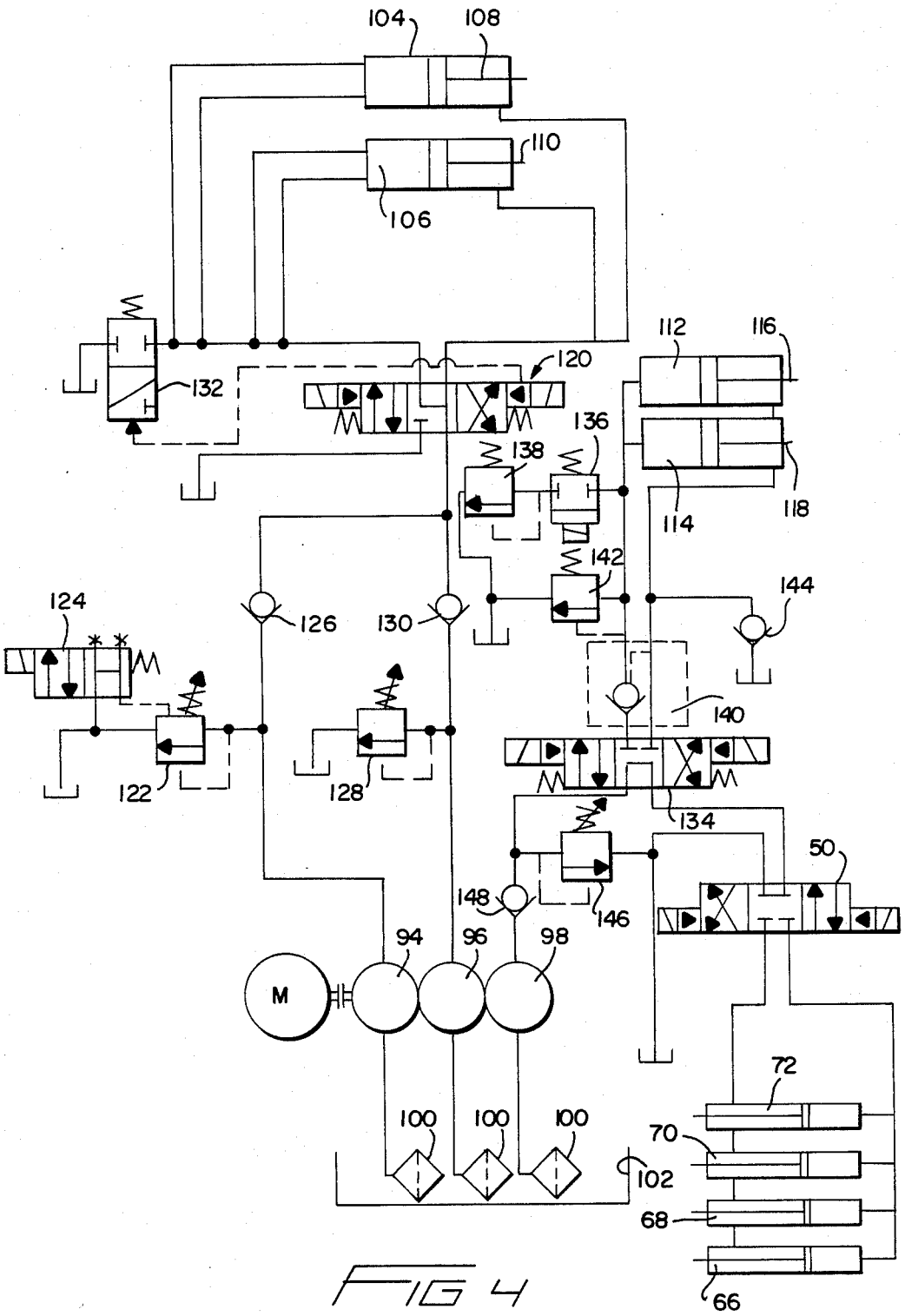

The hydraulic control system for achieving offsetting operation of the ram 26 and the gate 50 is best illustrated in FIG. 4. That figure discloses an hydraulic control mechanism for assuring that the pressures applied to the cylinder 28 offsets, when appropriate, the pressure applied to the cylinder and piston assemblies 60, 62 and 64. This offsetting relation, as previously noted, assures that the gate 50 pivots about the shaft 52 so as to achieve uniform compaction density by regulating the opening through which the waste is transported by operation of the ram 26.

Motor M is operably connected to pumping elements 94, 96 and 98. The elements 94, 96 and 98 are integral with pump 20 and the pump 20 is of a type well known in the art. Naturally, each of the elements 94, 96 and 98 has a filter 100 positioned within hydraulic fluid reservoir 102.

Pumping element 94 has a flow rate of 115 gallons per minute, whereas element 96 has a flow rate of 75 gallons per minute. Element 98, on the other hand, has a flow rate of 15 gallons per minute. We have found that the multi-element pump 20, as provided by the elements 94, 96 and 98, is one effective method of maximizing the available horsepower produced by the motor M. Those skilled in the art will understand that horsepower is a function of flow rate and pressure, so that for a given pressure, a higher horsepower is required for higher flow rates. Therefore, regulation of the flow rate for a given pressure is one method of making effective utilization of a motor.

High flow elements 94 and 96 are in flow communication with cylinders 104 and 106 which displace ram 26 within second portion 38. Naturally, each cylinder 104 and 106 has an associated piston 108 and 110, respectively, which is displaceable from the associated cylinder for causing displacement of the ram. Those skilled in the art will understand that the cylinders 104 and 106 are in flow communication with the pumping elements 94 and 96 by suitable lines, pipes and the like.

The low flow element 98, on the other hand, is in flow communication with the cylinders 112 and 114 which are operably connected to gate 50. Naturally, each of the cylinders 112 and 114 has an associated piston 116 and 118, respectively, which are displaceable for causing pivoting of the gate 50 about the shaft 52.

While FIG. 4 illustrates two cylinders 104 and 106 for displacing the ram 26, those skilled in the art will understand that a greater or fewer number of such cylinders may be used. Likewise, although only two cylinders 112 and 114 are illustrated in FIG. 4 for causing displacement of gate 50, those skilled in the art will understand that three such cylinders can be utilized as shown in FIG. 3, or a greater or fewer number, depending upon the size of the compactor assembly C. The two cylinders illustrated, 112 and 114, in FIG. 4 are merely illustrative and can be adapted to a greater number as situations warrant.

Four way three position solenoid valve 120 is in flow communication with the cylinders 104 and 106, as well as the high flow of pumping elements 94 and 96. As noted, the solenoid 120 is a three position solenoid, thereby having a regenerative mode permitting the fluid to flow to both ends of the cylinders 104 and 106 so that the pistons 108 and 110 will be outwardly displaced in view of the area differences across the associated pistons. The regenerative mode also reduces the power required to initially displace and retract the pistons 108 and 110, while permitting maximum flow for causing maximum speed. Those skilled in the art will understand that the solenoids 120 may be replaced with a system of cartridge style valves to facilitate decompression and a relatively rapid shifting sequence so that the cycling of the compactor assembly C can be maximized.

High flow element 94 has an unloading valve 122 for unloading the maximum flow high flow element 94 at a preselected pressure. The valve 122 is in flow communication with a two way two position valve assembly 124 for permitting fluid to flow to reservoir 102 as the unloading progresses. Also, check valve 126 is disposed between unloading valve 122 and solenoid 120 to protect the pumping element 94 and the related valve assemblies from back pressure in excess of a preselected level. The unloading valve 122 essentially takes the high flow element 94 out of the hydraulic system by shunting the flow to the reservoir, and thereby reduces the effective flow rate at a given pressure. This assures maximum utilization of the available horsepower produced by the motor M.

Safety valve 128 is disposed intermediate pumping element 96 and check valve 130 in order to provide a safety relief for the choker or gate 50 operating assembly. As with the check valve 126, the check valve 130 prevents excessive back pressure from damaging the pumping element 96, while permitting fluid to flow therefrom to the cylinders 104 and 106.

Return stroke dump valve 132 is in flow communication with the cylinders 104 and 106, and with the solenoid 120 for dumping hydraulic fluid to the reservoir 102 during retraction of the pistons 108 and 110. The dump valve 132 thereby assures maximum speed of retraction, and thereby faster cycling time.

Four way tandem spool solenoid valve 134 is in flow communication with low flow pumping element 98 and cylinders 112 and 114 for causing selective displacement of the pistons 116 and 118. As noted, the solenoid 134 is a tandem spool valve, thereby permititing the pumping element 98 to operate at all times, even while other hydraulic circuitry is maintaining the pistons 116 and 118 in a fully extended position, while also locking them in that position.

Solenoid valve 136 is in flow communication with the cylinders 112 and 114 and has an outlet in flow communication with pressure relief valve 138 which vents to reservoir 102. Pilot operated check valve 140 is disposed intermediate solenoid 136 and solenoid valve 134 and locks the pistons 116 and 118 in the fully extended position for thereby causing the gate 50 to assume the maximum pivoted position, so that the S-shaped portion 40 is totally blocked. In the fully blocked position, then no waste will be transferred to the outlet 48, even though the ram 26 is being displaced. Instead, compaction will continue. The solenoid valve 136, when in the non-flow position, thereby prevents fluid from flowing from the cylinders 112 and 114 to the pressure relief 138. Consequently, the pistons 116 and 118 remain locked in their extended position because the fluid can flow no where else, at least not until the pressure exceeds that required to open primary relief valve 142. A check valve 144 prevents fluid from venting to the reservoir 102 during retraction of the pistons 116 and 118.

A choker system safety relief valve 146 is disposed intermediate element 98 and solenoid valve 134 to permit fluid to flow to the reservoir 102 in the event of an over pressurization situation. A check valve 148 is also provided to protect the element 98.

The hydraulic system illustrated in FIG. 4 effectively controls the pressure applied through the pump 20 so that the ram 26 pressure and the choker or gate 50 pressure are offsetting. As the ram pressure decreases, indicating less dense refuse, then the choker pressure increases. This increases the resistance to flow of waste through the discharge section, S-shaped portion 40, and thereby increases the compaction. Conversely, as the ram pressure increases, thereby indicating waste of greater density, then the choker pressure decreases. The net result is a uniform degree of compaction at the discharge 48 of the elongated chamber, even though varying feed rates and varying densities of waste are being charged into opening 36.

The gate 50 acts as an arch breaker. In other words, the gate 50 can crush most materials that might bridge in the S-shaped portion 40. This feature is important because of the tendency for users to indiscriminately place waste of varying size into the opening 36, sometimes waste of rather substantial length.

The pins 74, 76, 78 and 80 pin off the waste at the outlet end 48 of the S-shaped portion 40 in order to assure that the compacted waste will break correctly. The pins furthermore assure the precise location of the break when the tractor pulls away. Each cylinder applies sufficient force to its associated pin to penetrate the waste log and to hold it in position. The pins enhance housekeeping by reducing the amount of loose waste material which is generated when the compacted waste log is broken. The waste log is broken by driving the trailer away and pulling the waste log in two. The pins hold the previously compacted material which would otherwise seep from the discharge 48 when the ram 26 is in the idle mode.

Directional control valve 150 supplies the pressurized hydraulic fluid to cylinders 66, 68, 70 and 72 in order to control displacements of the associated pins. It can be noted that the cylinders 66, 68, 70 and 72 are interconnected, as best shown in FIG. 4, in order to achieve essential simultaneous displacement.

The net effect achieved by the hydraulic system of FIG. 4, and the apparatus of FIGS. 1–3, is a payload of overall greater density than can be achieved by prior compactors. Therefore, each trailer carries more weight and less air, thereby decreasing the number of trips to the waste disposal site. The reduction in transportation costs is significant, and represents a major portion of the waste disposal cost.

OPERATION

Operation of the compactor assembly C is relatively straightforward, with most functions being handled by an electronic controller of a type well known to those skilled in the art. Furthermore, the pressure sensors, limit switches and the like are of rather conventional design and a number of such devices from various manufacturers can be utilized in practicing the method with the apparatus of the invention.

Initially, the ram 26 is in the retracted position so that the leg 32 clears the opening 36 and permits waste to be deposited into the second portion 38. Motor M is then initiated, through appropriate controls on control station 22, and the hydraulic pump elements 94, 96 and 98 being operating. Hydraulic fluid flows through the ram system directional control solenoid valve 120 to both the base end and the rod end of the cylinders 104 and 106. This causes fluid to flow in a regenerative mode, because of the use of a four way three position valve.

At the same time, hydraulic fluid flows from pumping element 98 to choker system directional control valve 134. The control valve 134 is shifted to direct fluid to the base end of the cylinders 112 and 114, thereby forcing the gate 50 into the fully blocked position within S-shaped portion 40. The cylinders 112 and 114 continue to pivot the gate 50 downwardly until the pressure in the base end of the cylinders 112 and 114 is 2400 PSI. Directional control valve 134 is then centered, thereby permitting fluid to free flow back to the reservoir 102. The pressure in the cylinders 112 and 114 is maintained at 2400 PSI by the net effect of the pilot operated check valve 140 and the solenoid valve 136.

The cylinders 104 and 106 continue to extend the associated pistons 108 and 110 while in the regenerative mode. This displacement is accomplished because the opposite faces of the pistons have differing surface area, thereby causing a net force effecting displacement. The pistons 108 and 110 move out at the maximum speed achievable with motor M because of the high combined flow rate of the pumping elements 94 and 96. The high displacement rate is obtainable because the waste is, at least initially, loosely positioned, thereby not generating much resistance to compaction by the moving ram 26. The pistons 108 and 110 continue to extend until the pressure in the base end of the cylinders 104 and 106 reaches 800 PSI.

Directional control valve 120 is then shifted to direct the hydraulic fluid to the base end of the cylinders 104 and 106 when the 800 PSI level is reached. The ram 26 continues to be extended by the pistons 108 and 110 until the pressure in the base end of the cylinders 104 and 106 achieves 850 PSI. At the 850 PSI level, then the high flow pumping element 94 is unloaded by the high/-low unloading valve 122. This unloading effectively takes the high flow pumping element 94 out of the system, thereby permitting the motor M to utilize its effective horsepower in pressurizing the output of elements 96 and 98. Thereby, maximum utilization of the available horsepower generated by the motor M is achieved.

The ram 26 continues to be extended by the pistons 108 and 110 with only the 75 GPM pumping element 96 pressurizing the cylinders 104 and 106. When the pressure in the cylinders 104 and 106 achieves 1800 PSI, then the secondary relief solenoid valve 136 opens, thereby permitting hydraulic fluid trapped by the pilot operated check valve 140 to flow through the secondary relief valve 138 until the pressure in the cylinders 112 and 114 decreases to 1800 PSI. Should the pressure in the main cylinders 104 and 106 achieve 1900 PSI, then the directional control valve 134 will shift, and thereby fluid will flow to the rod end of the cylinders 112 and 114. Pressure will then build in the cylinder rod line causing the pilot operated check valve 140 to open, and thereby permit the pistons 116 and 118 to retract until the pressure in the main cylinders 104 and 106 falls below 1700 PSI.

Should the pressure in the main cylinders 104 and 106 fall below 1600 PSI, then the directional control valve 134 will shift again, thereby causing the hydraulic fluid to flow to the base end of the cylinders 112 and 114. This will have the effect of extending the pistons 116 and 118 until such time as the pressure in the base end of the cylinders 104 and 106 goes above 1700 PSI. Eventually, the pistons 108 and 110 will cause actuation of a forward limit switch (not shown), thereby causing the directional control valve 120 to shift so as to cause the pistons 108 and 100 to retract to their starting position, at which time the cycle may again be repeated.

Those skilled in the art will understand that the hydraulic system illustrated in FIG. 4 has the effect of achieving offsetting operation of the cylinders 104 and 106 and cylinders 112 and 114. The gate 50 is pivoted from the open position to the fully blocked position as a means for restricting the flow of waste through the S-shaped portion 40, and eventually to outlet opening 48. Restriction of the opening in S-shaped portion 40 has the overall effect of causing an automatic adjustment in the pressure required to achieve displacement of the ram 26, which pressure is then controlled in response to the pressure applied to the cylinders 112 and 114 as a means for regulating the compacted density of the waste. Should the gate 50 pivot open too much, then the ram pressure will decrease by such an amount as to cause the control valve 134 to shift, thereby causing downward pivoting of the gate 50. Likewise, should the ram pressure increase beyond the selected amount, then the gate 50 will pivot upwardly to once again permit the ram pressure to come within the proper range. The overall effect is to achieve a target denisty of approximately 1000 pounds per cubc yard of compacted waste, although a greater or lesser target may be selected without departing from the scope of the invention.

While this invention has been described has having a preferred embodiment, it is understood that it is capable of further modification, uses and/or adaptions of the invention follow in general the principle of the invention and including such departures from the present disclosure as come within known or customary practice in the art to which the invention pertains, and as may be applied to the central features hereinbefore set forth, and fall within the scope of the invention of the limits of the appended claims.

What we claim is:

1. A uniform density compactor assembly, comprising:

(a) an elongated curvilinear chamber having a waste receiving end portion at a first elevation and a waste discharge end at a second higher elevation;

(b) ram means displaceable within said chamber for causing compaction of waste during transfer between said end portion and said end;
(c) first drive means operably connected to said ram means for causing displacement thereof;
(d) means positioned proximate said ends and being movable into and out of said chamber for selectively restricting said chamber and thereby controlling the passage of waste through said chamber;
(e) second drive means operably connected to said restricting means for causing displacement thereof;
(f) offset means operably interconnecting said first and second drive means for causing offsetting operation thereof so that the waste exits said end with a substantially uniform density;
(g) said first drive means including a first hydraulic cylinder and piston assembly;
(h) said second drive means including a second hydraulic cylinder and piston assembly; and
(i) said offset means including a hydraulic control means for continuously regulating the pressure of said second drive means as a function of the pressure of said first drive means.

2. The compactor of claim 1, wherein:
(a) said control means including means for incrementally decreasing the pressure of said second drive means as the pressure of said first drive means exceeds preselected values.

3. The compactor of claim 2, wherein:
(a) means for being operably connected with said second drive means for maintaining said second drive means at a first preselected pressure and for maintaining said second drive means at a second reduced pressure upon said first drive means exceeding a seleced pressure.

4. The compactor of claim 3, wherein:
(a) a multi-element hydraulic motor means operably connected to each of said drive means for supplying operating pressure thereto, each of the elements having a preselected flow output; and
(b) said motor means being operably connected to said control means so that the control means serially shunts the elements for thereby regulating fluid flow to said drive means.

5. The compactor of claim 4, wherein:
(a) first directional control valve means being interposed between said motor means and said first drive means for causing selected operation of said first drive means; and
(b) second directional control valve means being interposed between said motor means and said second drive means for causing selected operation of said second drive means.

6. The compactor of claim 5, wherein:
(a) said first directional control valve means is adapted for facilitating decompression and achieve rapid shifting of the associated first hydraulic cylinder and piston assembly; and,
(b) said second directional control valve means being a four way tandem spool solenoid valve for permitting fluid recycle.

7. The compactor of claim 4, wherein:
(a) said motor means including at least a first, second and third pumping element, said first element having a first flow output, said second element having a second reduced flow output and said third element having a third reduced flow output lower than said second element output; and,
(b) said first and second elements being operably connected to said first drive means and said third element being operably connected to said second drive means.

8. The compactor of claim 7, wherein:
(a) first shunting means in flow communication with said first element and with said first drive means, for shunting the flow from said first element so that said first element exerts no pressure on said first drive means.

9. The compactor of claim 7, wherein:
(a) said decreasing means including a solenoid valve in fluid communication with said second directional control means and said second drive means, said solenoid valve including an outlet; and,
(b) a pressure relief valve in flow communication with said outlet for reducing fluid pressure when said solenoid valve is operable to permit fluid to flow therethrough.

10. The compactor of claim 1, wherein:
(a) said restricting means including a gate means pivotal into and out of said chamber in response to displacement of said second drive means.

11. The compactor of claim 11, wherein:
(a) at least a first pin means disposed between said gate means and said end, said pin means being movable into and out of said chamber for preventing unintended discharge of waste from said end; and,
(b) third drive means being operably connected to said pin means for displacing said pin means.

12. The compactor of claim 11, wherein:
(a) said pin means moving orthogonal to said end; and,
(b) said second drive means extending generally parallel to said third drive means.

13. A density controlling compactor, comprising:
(a) an elongated chamber having a waste receiving end portion and a waste discharge opening spaced therefrom, said opening disposed above said end portion;
(b) ram means displaceable within said chamber for transferring waste from said portion of said opening;
(c) gate means disposed proximate said opening and being pivotal into and out of said chamber for restricting said chamber and thereby assisting waste compaction as said ram means is displaced;
(d) at least a first pin means disposed between said gate means and said opening and being displaceable into said chamber for preventing unintended discharge of waste through said opening;
(e) first drive means operably associated with said ram means for causing displacement thereof;
(f) second drive means operably associated with said gate means for causing displacement thereof;
(g) offset means operably interconnecting said first and second drive means for causing offsetting operation of said ram means and said gate means so that the pressure applied by said first drive means is adjusted in inverse relation to the pressure applied to said second drive means and the waste is thereby compacted to a substantially uniform density; and,
(h) third drive means operably connected to said pin means for causing displacement thereof.

14. The compactor of claim 13, wherein:
(a) said first, second and third drive means each including an hydraulic cylinder and piston assembly; and, (b) said offset means including an hydraulic control assembly for regulating the hydraulic pressure of said first and second drive means so that an increase in the pressure of said first drive means causes a decrease in the pressure of said second drive means and an increase in the pressure of said second drive means causes a decrease in the pressure of said first drive means.

15. The compactor of claim 14, wherein:

(a) said control assembly including means for maintaining said second drive means at a first selected pressure until said first drive means exceeds a second selected pressure and for thereafter regulating the pressure of said second drive means as a function of the pressure of said first drive means.

16. The compactor of claim 14, wherein:

(a) hydraulic motor means being in flow communication with said first and second drive means, said motor means having at least first, second and third pumping elements;

(b) said first and second elements being in flow communication with said first drive means and said third element being in flow communication with said second drive means; and (c) said first element having a first fluid flow output exceeding the fluid flow output of said second element, said second element fluid flow output exceeding said third element fluid flow output.

17. The compactor of claim 16, wherein:

(a) said hydraulic control assembly including means for shunting said first element when the pressure of said first drive means exceeds a preselected amount so that said first element exerts no pressure on said first drive means, thereby controlling the power required to displace said ram means.

18. The compactor of claim 16, wherein:

(a) valve means adapted for facilitating decompression and achieving rapid shifting of the associated cylinder and piston assembly interposed between said motor means and said first drive means; and, (b) a four way tandem spool solenoid valve interposed between said motor means and said second drive means.

19. The compactor of claim 15, wherein:

(a) said maintaining means including a first solenoid valve in flow communication with said second drive interposed between said motor means and said second drive means.

20. The compactor of claim 13, wherein:

(a) said second and third drive means extending parallel and generally transverse to said first drive means; and (b) said pin means extending generally orthogonal to said chamber.

21. The compactor of claim 20, wherein:

(a) there being a plurality of pin means extending in spaced parallel alignment across said chamber, said pin means lying on a plane disposed transverse to said chamber.

22. The compactor of claim 21, wherein:

(a) said chamber including a longitudinally extending first portion through which said ram means is displaced, an S-shaped portion extending therefrom and in which said gate means is located and a second longitudinally extending portion extending from said S-shaped portion; and, (b) said second and third drive means being operably connected to said second longitudinally extending portion.

23. The method of compacting waste to a uniform density, comprising the steps of:

(a) providing a compactor assembly including an elongated curvilinear compactor chamber having a waste receiving opening at one end and at a first elevation, a waste discharge opening at another end and at a second higher elevation, a pivotal gate means intermediate said openings for selectively blocking said chamber and ram means for compacting the waste during transit thereof between said openings (b) supplying a quantity of waste to said chamber;

(c) blocking said chamber by pivoting said gate means and thereby preventing waste from exiting said discharge opening;

(d) compacting the waste by advancing said ram means towards said gate means; and, (e) selectively pivoting said gate means in response to the force required to displace said ram means so that said chamber is progressively unblocked as the force required to displace said ram means increases, and said chamber is progressively blocked as the force required to displace said ram means decreases and the pivoting of said gate means and the advancing of said ram means is effected through a common motive source.

24. The method of claim 23, including the step of:

(a) maintaining said gate means in said blocked position until the force required to displace said ram means exceeds a selected level and then operating said ram means and said gate means in offsetting relation.

25. The method of claim 23, including the steps of:

(a) positioning pin means proximate said discharge opening; and, (b) displacing said pin means and thereby blocking said discharge opening after a selected quantity of compacted waste has been discharged through said discharge opening.

26. The method of claim 23, including the steps of:

(a) advancing said ram means by hydraulic motor means having at least three pumping elements; and, (b) utilizing less than all of said elements when the force required to displace said ram means exceeds a selected level.

27. The method of claim 25, including the step of:

(a) obtaining fluid for hydraulically displacing said ram means, said gate means and said pin means from a common hydraulic source.

* * * * *